US007764873B2

(12) United States Patent
Panaghe

(10) Patent No.: US 7,764,873 B2
(45) Date of Patent: Jul. 27, 2010

(54) RADIANT ELECTRICATING ELEMENT WITH PRINTED HEATING AND CERAMIC TRACKS

(76) Inventor: Stylianos Panaghe, Smith House, Stocks Lane, Over Peover, Knutsford, Cheshire WA16 8TW (GB)

( * ) Notice: Subject to any disclaimer, the term of this patent is extended or adjusted under 35 U.S.C. 154(b) by 687 days.

(21) Appl. No.: 10/820,401

(22) Filed: Apr. 8, 2004

(65) Prior Publication Data

US 2005/0002659 A1 Jan. 6, 2005

Related U.S. Application Data

(60) filed as application No. pct/gb2002/04581 on Oct. 9, 2002.

(30) Foreign Application Priority Data

Oct. 9, 2001 (GB) ..... 0124190.0

(51) Int. Cl.
*H05B 3/20* (2006.01)

(52) U.S. Cl. ..... 392/435; 338/307; 219/543

(58) Field of Classification Search ..... 219/543, 219/546–548, 552, 521; 392/435, 438–440; 338/307–309, 262, 292–293; 99/389–401
See application file for complete search history.

(56) References Cited

U.S. PATENT DOCUMENTS 2,495,788 A * 1/1950 Trist ..... 392/435
RE23,555 E * 9/1952 Mochel ..... 338/327
2,673,142 A * 3/1954 Glynn ..... 216/42
2,859,321 A * 11/1958 Garaway ..... 338/255
2,939,807 A * 6/1960 Needham ..... 216/16
3,109,228 A * 11/1963 Dyke et al. ..... 29/620
3,146,692 A * 9/1964 Connolly et al. ..... 99/379
3,349,722 A * 10/1967 Davis ..... 104/279
3,524,404 A * 8/1970 Shinzo et al. ..... 99/390
3,534,148 A * 10/1970 Bange ..... 174/255
3,978,315 A * 8/1976 Martin et al. ..... 219/543
4,203,025 A * 5/1980 Nakatani et al. ..... 347/203
5,068,517 A * 11/1991 Tsuyuki et al. ..... 219/543
5,252,809 A * 10/1993 Demin ..... 219/543
5,657,532 A 8/1997 Turvey et al.
5,998,049 A 12/1999 Fukuda et al.
6,121,586 A 9/2000 Doyle et al.

(Continued)

FOREIGN PATENT DOCUMENTS

GB 2199733 * 7/1988

*Primary Examiner*—Thor Campbell
(74) *Attorney, Agent, or Firm*—Gauthier & Connors, LLP

(57) ABSTRACT

A radiant electric heating element for use in a toast making appliance comprises a base plate (2) of stainless steel to one or each face of which there is printed a first ceramic track (3) with an electrically conductive track (5) printed on the face thereof remote from the base plate (2), and a second ceramic track (4) is printed upon and surrounds the heating track (5) thus hermetically sealing with the heating track between the two ceramic tracks. Such an element provides adequate radiant heat for efficiently toasting bread while the bread may be in direct contact with the element but is electrically insulated therefrom by the second ceramic track (4). By providing a further ceramic coating (6) on the opposed face of the base plate (2), mechanical integrity is maintained to prevent warping of the element and thus uneven toasting.

17 Claims, 2 Drawing Sheets

U.S. PATENT DOCUMENTS 6,125,234 A * 9/2000 de Jenlis ..... 392/439
6,137,089 A 10/2000 Pragt et al.
6,323,467 B1 * 11/2001 Alsafadi ..... 219/480
6,341,554 B2 * 1/2002 Thiriat ..... 99/327
6,730,888 B1 * 5/2004 Battu ..... 219/502

* cited by examiner

RADIANT ELECTRICATING ELEMENT WITH PRINTED HEATING AND CERAMIC TRACKS

This application is a Continuation of PCT/GB2002/04581 filed Oct. 9, 2002.

BACKGROUND OF THE INVENTION

1. Field of the Invention

THIS INVENTION concerns radiant electric heating elements particularly, though not exclusively, for heating food products where the heating element is disposed closely against the product to be heated. Such an application would be a bread toasting appliance so that the heating element is producing radiant heat in a dry environment to toast the bread.

2. Description of the Prior Art

Electrical toast making appliances, both manual and automatic have been around for many years, they were in the main constructed of a wire wound heating element embodied in a mechanism in such a manner that the material to be toasted is inserted at a suitable distance between and away from the heating elements, so as not to come into contact therewith. To overcome the disadvantage of large separation between the heating element and the toasting material, additional energy is required. Toasters are either manual or automatic. Manual toasters consist of a mechanical switch timer with a manual insert/ejector, whilst automatic toasters have an indirect browning sensor triggering a toasting material ejector to raise the bread slice to a level of safe accessibility.

Traditionally, the heating elements have consisted of an electrical resistance wire of a suitable resistance value wound round either a mica plate supported in a metal frame or on a suitable length of ceramic rod or a spiral heating element enclosed in a quartz tube. They are delicate and easily damaged.

To prevent the toasting material and the operator from coming in contact with the electrical conducting resistance wire a metal wire grid is inserted and spaced at a suitable and safe distance from the heating element, thus preventing the user from sustaining an electric shock. In addition, the grid centres the toasting material and acts both as a reflector and absorber of the energy thus reducing by a not insignificant factor the energy being received by the bread.

The above method of toasting relies essentially on the radiation of heat from the heating elements, with the minor assistance of convection. This consumes relatively high amounts of energy for the required task.

SUMMARY OF THE INVENTION

According to the present invention, there is provided a radiant electric heating element comprising a base plate, a first ceramic track printed on at least one face of the base plate, an electrically conductive heating track printed on the surface of the first ceramic track lying remote from the base plate, and a second ceramic track printed on the heating track thus with the first ceramic track to surround and seal the heating track, terminal means being connected to the heating track for connecting same to a supply of electrical power.

Further according to the present invention there is provided a method of producing a radiant electric heating element according to any preceding claim, wherein the base plate is of stainless steel.

It is an object of the present invention to provide a radiant electric heating element in which the useful life of the element is expected to be increased, and which will operate on reduced power consumption while ensuring safer user operation and the inherent ability for the element to be cleaned.

Further according to the present invention there is providing a toast making appliance comprising at least one radiant electric heating element as aforesaid, including means for supporting at least one slice of bread in close proximity to the heating element, even in direct contact therewith.

The technique proposed here is that the toasting of bread can be improved by moving it closer to and almost in touch with the printed heating element. The printed heating element is fabricated on a thin plate of a suitably selected grade of stainless steel after a cleaning procedure that ensures the steel surface is free of any contaminants.

Preferably, two or more such plates are placed in parallel. The distance between them and the power-on time of the plates determines the user's toast requirements. These are user adjustable before and/or after inserting the material to be toasted.

The method of determining the degree of toasting can be either manual, or automatic. The manual type will have its energising power controlled by an adjustable time switch which can be either electronic or mechanical, whilst the automatic type will have its energising power controlled by a user-adjustable browning level detector.

An infrared emitter-receiver scanning detector may act as a browning sensor. In such a device, the infrared beam is directed to, and at suitable positions on, the surface of the material being toasted, monitoring the change in colour. The colour setting control then activates completing the process. It may be that the material to be toasted starts with a different colouring thus having a different rate of change of colour. This difference in the final colour of the toasted material is set by auto-zeroing the initial conditions at each and every toasting process.

A heating element can be printed either in single or multiple tracks, either on one side or both sides, meandered in such a fashion as both to cover the whole area of the plate and to ensure a power distribution over the plate for an even toasting of the material.

BRIEF DESCRIPTION OF THE DRAWINGS

An embodiment of the invention will now be described, by way of example, with reference to the accompanying drawings, in which.

Figure 3:
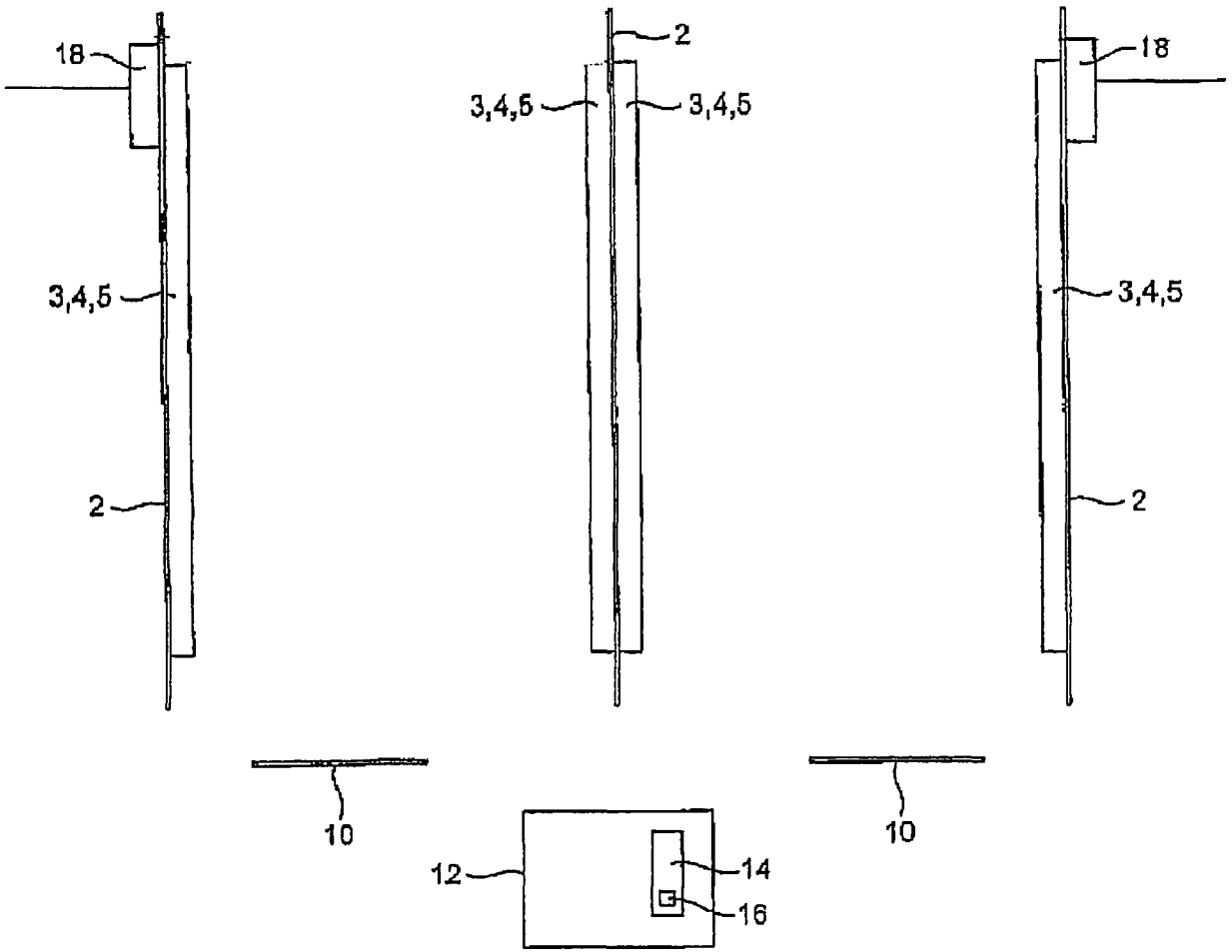
FIG. 3 is a cross-section view of an arrangement of multiple radiant electric heating elements.

By placing a pair of radiant electric heating elements according to the invention back-to-back slices of toast may be introduced between them. preferably on supporting means (10), so that both sides are toasted simultaneously, and by providing three such elements, as shown in FIG. 3, two or more slices may be toasted at once.

DETAILED DESCRIPTION OF THE INVENTION

Figure 1:
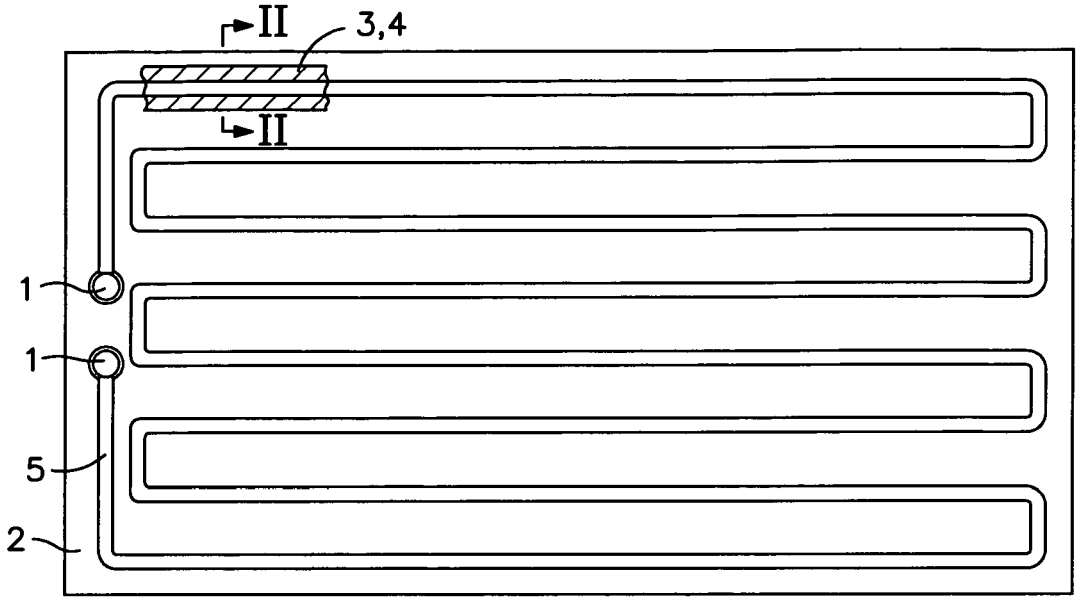
FIG. 1 is an elevation of a radiant electric heating element made in accordance with the invention.
Figure 2:
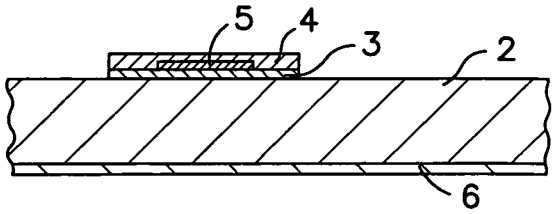
FIG. 2 is a cross-section, taken on line II—II of FIG. 1.

By way of example, a heating element configured for a side-by-side toasting is shown in FIG. 1 indicating the heating element track(s) (5) of suitable width printed on a relatively wider ceramic track (3) (FIG. 2) with the same configuration which is itself printed on a stainless steel plate (2) having a low thermal mass. It is then covered with a high temperature insulating material (4), usually the same material as is used for printing the ceramic track(s), the electrically conducting resistance track (5) thus becomes hermetically sealed. Such an arrangement essentially eliminates the use of a protective metal grid. The toast can be in direct contact with the heating element itself as the heating element is electrically insulated from the toast. Electrical connections (1) for the supply of power can be by means of either spring contact, or by insulating fasteners, or by soldering.

The ceramic insulating layers (3, 4) protect the user from coming into contact with the electrically conducting track (5) and thus prevents the risk of an electric shock.

The use of printed heating elements in a toaster offers several advantages. For example, the electrical power required to toast bread can now be relatively reduced, and the mechanism for inserting and centring the toasting material becomes easier, including the not insignificant factor of cleanliness in that the plates can be wiped clean.

There are instances where the user inserts other readily available kitchen utensils, knives forks, etc. to remove or adjust the toasting material, although these actions are momentarily convenient they may conventionally result in the user accidentally burning himself, but with the heating element being hermetically sealed it will prevent an electric shock, or destruction of the toaster elements which was a common event in wire wound toaster elements.

By placing a pair of radiant electric heating elements according to the invention back-to-back slices of toast may be introduced between them so that both sides are toasted simultaneously, and by providing three such elements, two or more slices may be toasted at once.

If required, means may be provided (18) for effecting relative movement of the several heating elements towards and away from each other thus, selectively, to open or close the gap between the elements and thus the distance therefrom the slices of bread.

An infrared emitter-receiver scanning detector (14) can act in a browning sensor (12). An infrared beam acts on the material being toasted to monitor any change in colour. The difference in the final colour of the material to be toasted is set by auto-zeroing means (16) at each toasting process.

It is envisaged that the thickness of the stainless steel plate (2) will be in the region of 0.5 m while the ceramic tracks will each be in the region of 75 microns in thickness surrounding the heating track which will be in the region of 0.3 to 1 microns in thickness.

Preferably, a further layer (6) of dielectric substrate may be applied to the face of the stainless steel plate (2) remote from that to which the tracks (3) and (5) are applied, in order to assist in preventing the stainless steel plate from warping.

The whole assembly is preferably bonded as a composite unit.

An element made in accordance with the invention may generate a temperature in the region 300° C. to 400° C. thus rapidly to toast bread placed in close proximity therewith.

While this invention has been described in relation to a toast making appliance, it may equally be used for heating, by radiation, any other substance which may lie in close proximity therewith in a dry environment.

Material which may typically be used for the construction of such a heating element are ceramified glass for the dielectric ceramic tracks; silver, palladium or platinum for the conductive heating track, and the stainless steel base may be of the type having a chromium content of 17%, such a material being known by the reference number 430317 stainless steel.

What is claimed is:

1. A radiant electric heating element comprising a base plate, a first ceramic track printed on at least one face of the base plate, n electrically conductive heating track printed on the surface of the first ceramic track lying remote from the base plate, a second ceramic track printed on the heating track thus with the first ceramic track to surround and seal the heating track, terminal means being connected to the heating track for connecting same to a supply of electrical power.

2. The radiant electric heating element according to claim 1, wherein both ceramic tracks are wider than the heating track.

3. The radiant electric heating element according to claim 1, wherein the combined ceramic and heating tracks follow a meander pattern to cover a substantial area of the base plate.

4. The radiant electric heating element according to claim 1, wherein a ceramic layer is printed or coated onto the face of the base plate remote from the ceramic and heating tracks.

5. The radiant electric heating element according to claim 1, wherein the combined ceramic and heating tracks are printed on opposed faces of the base plate.

6. The radiant electric heating element according to claim 1, wherein multiple combined ceramic and heating tracks are printed on opposed faces of the base plate.

7. The radiant electric heating element according to claim 1, wherein the first and second ceramic tracks are formed from the same material.

8. The radiant electric heating element according to claim 1, wherein the base plate is of stainless steel.

9. A method of producing a radiant electric heating element, comprising the steps of providing a base plate, printing a first ceramic track on at least on face of the base plate, printing an electrically conductive heating track on the surface of the first ceramic track lying remote from the base plate, such that the heating track is electrically insulated therefrom, printing a second ceramic track on the heating track so that with the first ceramic track the heating track is surrounded and sealed by the first and second ceramic tracks, and providing terminal means for connection of the heating track to a supply of electric power.

10. The method according to claim 9, wherein the base plate is cleaned to ensure that the surface thereof is free of any contaminants, before printing thereon of the first ceramic track.

11. The method according to claim 9, wherein the combined ceramic and heating tracks are printed on opposed faces of the base plate.

12. The method according to claim 9, wherein multiple combined ceramic and heating tracks are printed on opposed faces of the base plate.

13. A toast making appliance comprising at least one radiant electric heating element according to claim 1, including means for supporting at least one slice of bread in close proximity to the heating element, even in direct contact therewith.

14. The toast making appliance according to claim 13, wherein a pair of radiant electric heating elements, are placed in mutually parallel relationship, means being provided to enable adjustment of the distance between said parallel pair of elements.

15. The toast making appliance according to claim 13, including a browning sensor.

16. The toast making appliance according to claim 15, wherein said browning sensor is an infra-red emitter-receiver scanning detector.

17. The toast making appliance according to claim 16, including means to auto-zero the scanning detector before each toasting operation, thus to provide browning control of breads having different initial colours.

* * * * *